US005243262A

United States Patent [19]

Moen

[11] Patent Number: 5,243,262

[45] Date of Patent: Sep. 7, 1993

[54] METHOD AND APPARATUS FOR COMPENSATING ALTERNATING ELECTRICAL FIELDS PRESENT AT THE FRONT SURFACE OF A CATHODE PICTURE TUBE

[75] Inventor: Tor Moen, Oslo, Norway

[73] Assignee: Tandberg Data A/S, Norway

[21] Appl. No.: 808,738

[22] Filed: Dec. 17, 1991

[51] Int. Cl.[5] ..... H01J 29/56

[52] U.S. Cl. ..... 315/370; 315/8; 315/85

[58] Field of Search ..... 315/370, 411, 8, 85

[56] References Cited

U.S. PATENT DOCUMENTS 4,636,911 1/1987 Truskalo ..... 315/8

5,151,635 9/1992 Cappels ..... 315/8

*Primary Examiner*—Theodore M. Blum

*Attorney, Agent, or Firm*—Hill, Steadman & Simpson

[57] ABSTRACT

A method and apparatus for compensating the alternating electrical fields present at the front surface of a cathode ray picture tube wherein the high-voltage signal supplied to the high-voltage terminal of the tube is tapped to extract an alternating voltage signal therefrom, and the alternating voltage signal is inverted and amplified and then applied to a suitable external electrode placed in the proximity of the picture tube. The external electrode can be a framing band, an aquadag region or a ring electrode, among other things. Furthermore, combination of these electrodes can be employed.

25 Claims, 4 Drawing Sheets

METHOD AND APPARATUS FOR COMPENSATING ALTERNATING ELECTRICAL FIELDS PRESENT AT THE FRONT SURFACE OF A CATHODE PICTURE TUBE

BACKGROUND OF THE INVENTION

The invention generally is directed to a method for compensating alternating electrical fields present at the front surface of a cathode picture tube. Additionally, the invention generally is directed to an apparatus that is suitable for carrying out the method. More specifically, the invention is directed to a method and apparatus for compensating the alternating electrical field at the front surface of a cathode tube produced by a high-voltage signal generator that supplies a high-voltage signal to the picture tube via an EHT high-voltage terminal.

Many countries have safety rules and recommendations for users of cathode ray picture tubes that, for example, are employed in television equipment and video equipment, or as data terminal equipment and monitors in data processing equipment. These rules generally provide that the alternating electrical fields outside of the apparatus employing the picture tubes not exceed a defined value.

To that end, Swedish and other authorities have specified that at a distance of 30 centimeters from the front surface of a cathode ray picture tube, the voltage of the alternating electric field not exceed 1 volt per meter in the frequency range of 2 kHz to 400 kHz. Additionally, these authorities have specified that the voltage of the electric field at this distance not exceed 10 volts per meter in the frequency range of 5 kHz through 2 kHz.

Without the use of special structures or arrangements to compensate for the electrical fields present at the front surface of a picture tube, the strengths of the alternating electric field of concern in these frequency ranges have been known to amount to several tens of volts per meter.

In accordance with prior methods, it is possible to weaken the alternating electrical field by placing a glass plate in front of the front surface of the picture tube. The glass plate generally is coated with a low-impedance layer by means of which charges occurring due to the alternating field are drained or flow off, so that the effect of these charges is largely cancelled. However, the image quality of the picture is degraded by the glass plate. Moreover, the glass plate presents a not inconsiderable additional cost.

It is also possible to attenuate the alternating voltage signal of the picture tube that is responsible for generating the alternating electrical field in front of the picture tube. The high-frequency portions of this alternating voltage derive from the deflection frequency and its harmonics, particularly from the capacitive coupling in the rectifier of the high-voltage generator (also referred to as an EHT generator), and from the capacitive coupling of the deflection coils. The low-frequency portion of this alternating voltage results from current fluctuations in the picture tube and by the internal impedance of the EHT generator. Although these frequencies can be decoupled with a capacitor, this generally is impractical when the strength of the alternating electrical field is to be kept below the required lower limit of 1 volt per meter given a distance of 30 centimeters in front of the picture tube, because a large external capacitor would be required for this purpose.

SUMMARY OF THE INVENTION

The invention provides a method for compensating the alternating electrical field resulting at the front surface of a cathode ray picture tube in a simple and effective manner. The invention also provides an apparatus with which the alternating electrical field resulting at the front surface of a cathode ray picture tube can be compensated and that is particularly suited for the implementation of the method of the invention.

To these ends, the invention provides that the alternating voltage on the connecting line between the high-voltage generator and the EHT high-voltage terminal is sensed, the sensed alternating voltage is inverted and amplified, and the inverted and amplifier sensed voltage is then delivered to at least one external electrode provided in the immediate proximity of the picture tube.

In an embodiment, the invention provides an apparatus for compensating the alternating electrical field comprising an inverting amplifier having an input coupled to a tap in a connecting line coupling the high-voltage generator and the EHT high-voltage terminal of a cathode ray picture tube. An output of the inverting amplifier is coupled to at least one external electrode positioned in the immediate proximity of the picture tube. The alternating voltage is inverted and amplified sufficiently to compensate for the alternating voltage of the electric field at the outside surface of the picture tube.

In accordance with the foregoing, an adequate compensation of the alternating electrical field can be achieved with this method or, respectively, with this apparatus. The compensation is based on two effects. First, the internal alternating voltage of the picture tube is reduced. Second, the alternating electrical field generated by the remaining, internal alternating voltage is attenuated by the linear superposition on the field of the inverted alternating voltage. These two effects together provide the desired compensation of the alternating electrical field.

Preferably, the gain of the inverting amplifier is controllable so that the compensation can be matched to the particular cathode ray picture tube in which it is employed.

Further, the external electrode is or, respectively, the external electrodes are expediently arranged outside a front surface of the cathode ray picture tube.

The invention provides a particular advantage when the external electrode or electrodes at least partially surrounds or surround, respectively, the front surface of the cathode ray picture tube. What can be achieved in this instance is that the inverted alternating voltage generates an alternating field that uniformly covers the front surface of the cathode ray picture tube so that an optimum compensation is provided.

In accordance with the invention, the external electrode or electrodes can be provided in a variety of forms. To this end, an external electrode can be a ring electrode arranged outside the front surface of the cathode ray picture tube. This would require a component and separate apart from the cathode ray tube, but this would have the advantage that the formation of the inverted signal field can be influenced as desired.

Moreover, an external electrode can be a framing band that surrounds the cathode ray picture tube. Such a rim band generally is already present on a picture tube, so that, other than the required leads to connect thereto, no further structural elements need be provided in addition to the cathode ray tube.

Yet further, a external electrode can be the aquadag region of the cathode ray picture tube. The aquadag region is usually composed of a colloidal graphite-water dispersion that has electrically conductive properties.

Depending on the construction of the electrode and depending on the type of electrode employed, it is necessary to variously amplify the AC voltage signal that is extracted from the EHT high-voltage terminal. When, for example, an outside electrode is employed as the external electrode, the compensation effect is mainly based on the superposition of the field generated from the inverted alternating voltage signal and that part of the compensation that is attributed to the reduction of the internal alternating electrical voltage is relatively slight. Therefore, a high gain of the alternating voltage is required in order to be able to generate the high alternating electrical field required to effect the compensation.

In addition to the forgoing, in an embodiment of the invention, a metallic sleeve, preferably a copper sleeve, that at least partially surrounds the connecting line between the high-voltage generator and the EHT high-voltage terminal, is provided for sensing or as a tap for extracting the alternating voltage signal. An inverting amplifier input then is coupled to the sleeve.

In another preferred embodiment of the invention, when the external electrode is provided as the aquadag region, a low-pass filter is interposed between the connecting line coupling the high-voltage generator to the EHT terminal and the input of the inverting amplifier. One output of the inverting amplifier is connected to the output of the low-pass filter to provide feedback thereto.

These and other features of the invention will become clearer with reference to the following detailed description of the presently preferred embodiment and accompanying drawings.

DETAILED DESCRIPTION OF THE PRESENTLY PREFERRED EMBODIMENTS

In accordance with the invention, to compensate for an alternating voltage electrical field generated at the outside surface of a cathode ray picture tube, an AC signal is extracted from a connecting line coupling a high-voltage generator to an EHT high-voltage terminal of the picture tube, and then the AC voltage signal is amplified, inverted and delivered to at least one external electrode provided in the immediate proximity of the picture tube. Various arrangements for accomplishing this compensation are illustrated in the figures.

Figure 1:
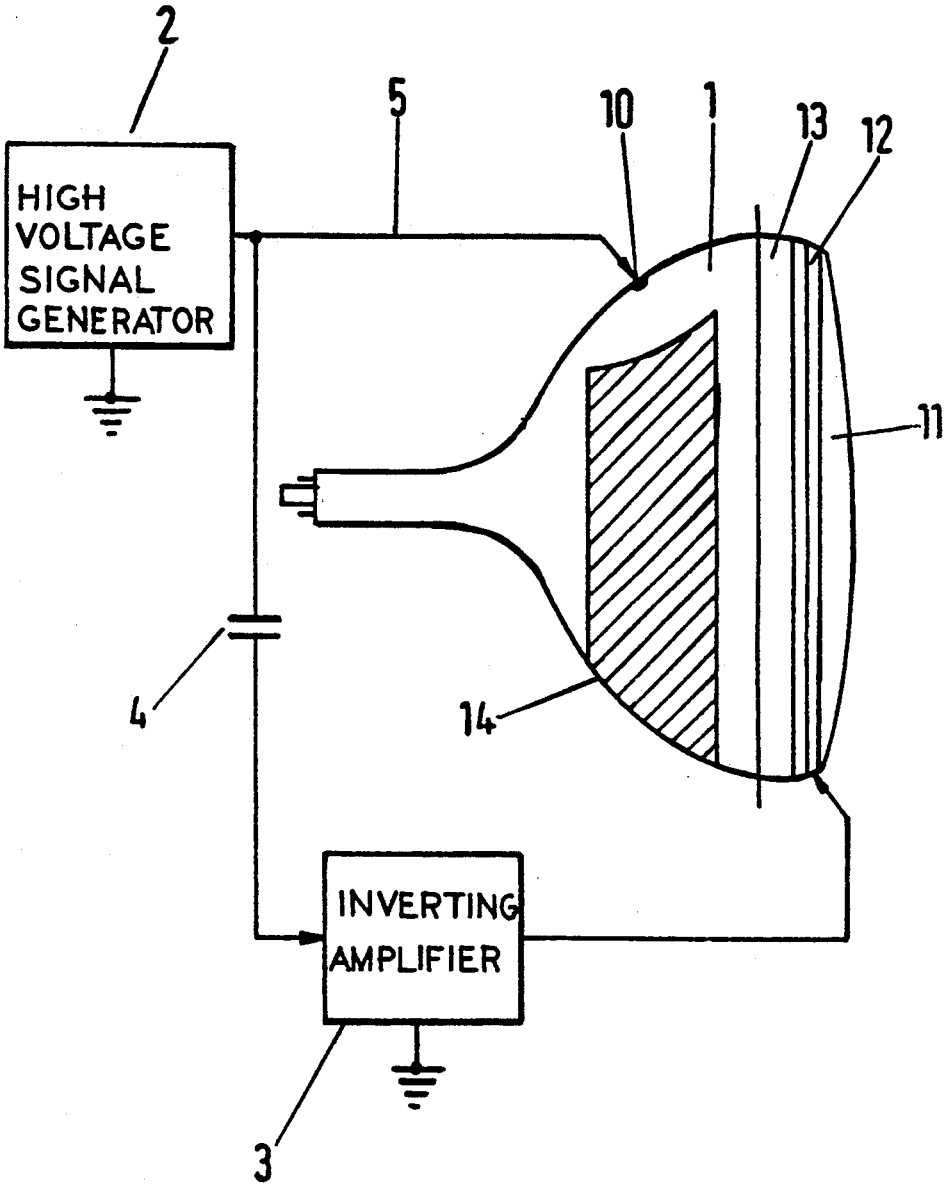
FIG. 1 is a schematic illustration of a cathode ray tube with an alternating field compensation arrangement.

In FIG. 1 there is illustrated a typical commercially available cathode ray picture tube 1. The tube 1 includes a high-voltage terminal 10, referred to as the EHT terminal, by means of which an internal alternating voltage signal is conducted out from the interior of the picture tube 1.

Coupled to the EHT terminal 10 is the output of a high-voltage generator 2. A connecting line 5 couples the output of the voltage generator 2 to the EHT terminal 10.

As further illustrated, a capacitor 4 having a terminal coupled to the connecting line 5 provides a tap for directing an alternating voltage signal present at the connecting line 5 to an inverting amplifier 3. The output of the inverting amplifier 3 is then coupled to a ring electrode 12 that surrounds a front surface 11 of the picture tube 1.

Both the high voltage generator 2 as well as the inverting amplifier 3 are grounded. The ring electrode 12 is constructed such that it lies outside of the picture field of the picture tube 1.

By means of the foregoing construction, the high frequency field generated by the high-frequency portion of the alternating voltage signal captured from the connecting line 5 can be compensated via the outer electrode 12 that surrounds the front surface 11 of the picture tube 1. The amplitude of the alternating voltage is not particularly high, and for example, it has a peak-to-peak value of approximately 35 volts.

It can be appreciated that there are various constructions by means of which the required AC voltage portion can be tapped from the connecting line 5. Examples of such constructions include the direct connection of FIGS. 1, 3 and 4 and the construction of FIG. 2 wherein a copper sleeve is placed around the connecting line 5 between the high-voltage generator 2 and the EHT terminal 10. The illustration of FIG. 2 only is schematic and is not intended to be to scale.

Figure 2:
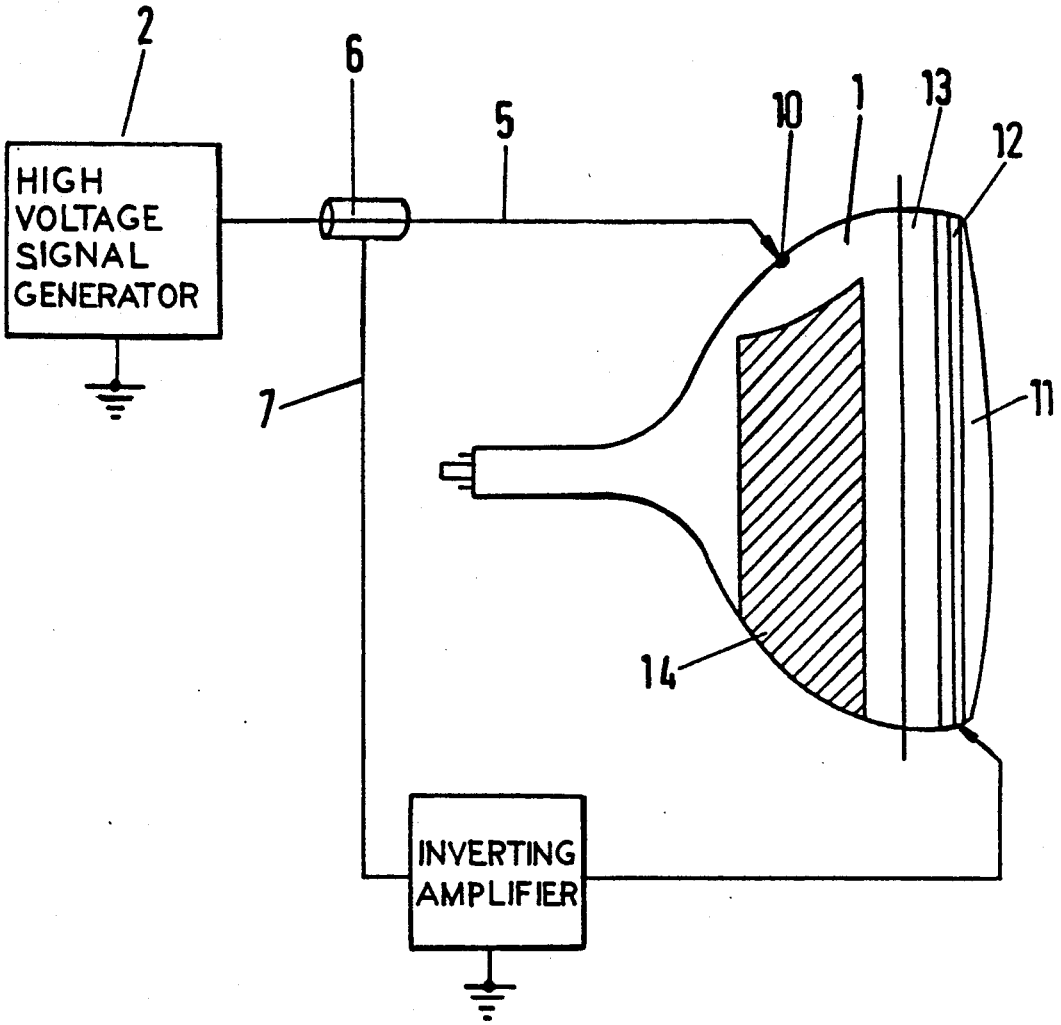
FIG. 2 is a schematic illustration of an arrangement similar to that of FIG. 1, but further including a metallic sleeve provided as a signal tap.

In the variation of FIG. 2, a line 7 is coupled between the sleeve 6 and the input of the inverting amplifier 3. In all other respects, the construction of FIG. 2 is the same of that of FIG. 1.

In addition to a high-frequency alternating voltage field, many picture tubes have a low-frequency field that is indirectly attributed to the presence of the aquadag region. In this regard, a capacitance is formed between the EHT terminal 10 and the aquadag region 14 with which internal current fluctuations are eliminated from the picture tube. These low-frequency field also can be compensated.

Figure 3:
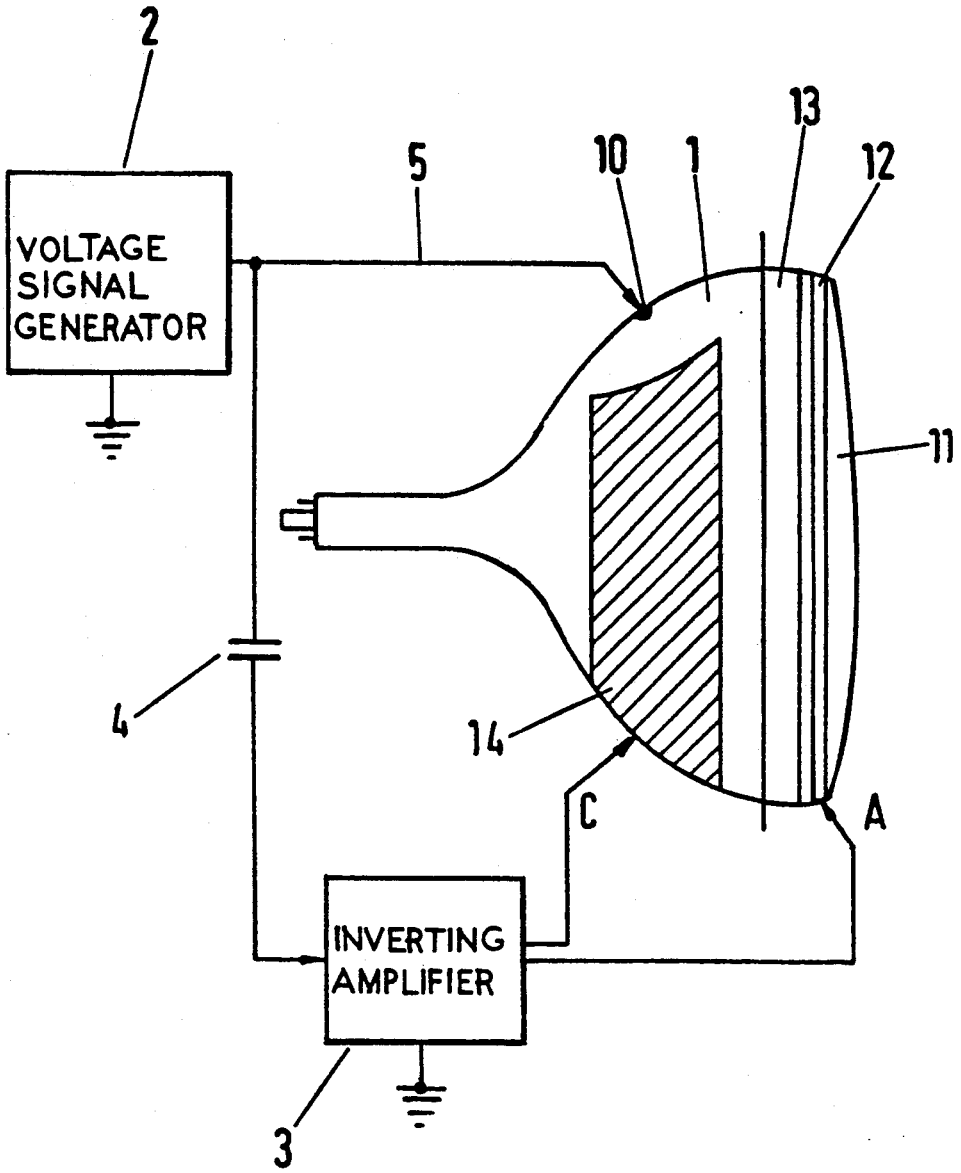
FIG. 3 is a schematic illustration of an alternate alternating field compensation arrangement.

In FIG. 3 there is illustrated a construction similar to that of FIG. 1 including a picture tube 1, a high-voltage generator 2, an inverting amplifier 3, and a capacitor 4. The picture tube is provided with an aquadag region 14 in a region facing away from its front surface 11. As previously set forth, the AC voltage portion of the high-voltage generated by the high-voltage generator 2 is captured on the connecting line and is forwarded first onto the ring electrode 12 via a line A, and further, directly onto the aquadag region 14 via another line C. In the manner, the AC field present on the aquadag region is also compensated.

It can be appreciated that the voltage fluctuations in conjunction with the aquadag region 14 represent the low-frequency portion of the distributing alternating voltage field whose amplitude, however, is comparatively high. The peak-to-peak value can thereof amount to up to 100 volts.

Figure 4:
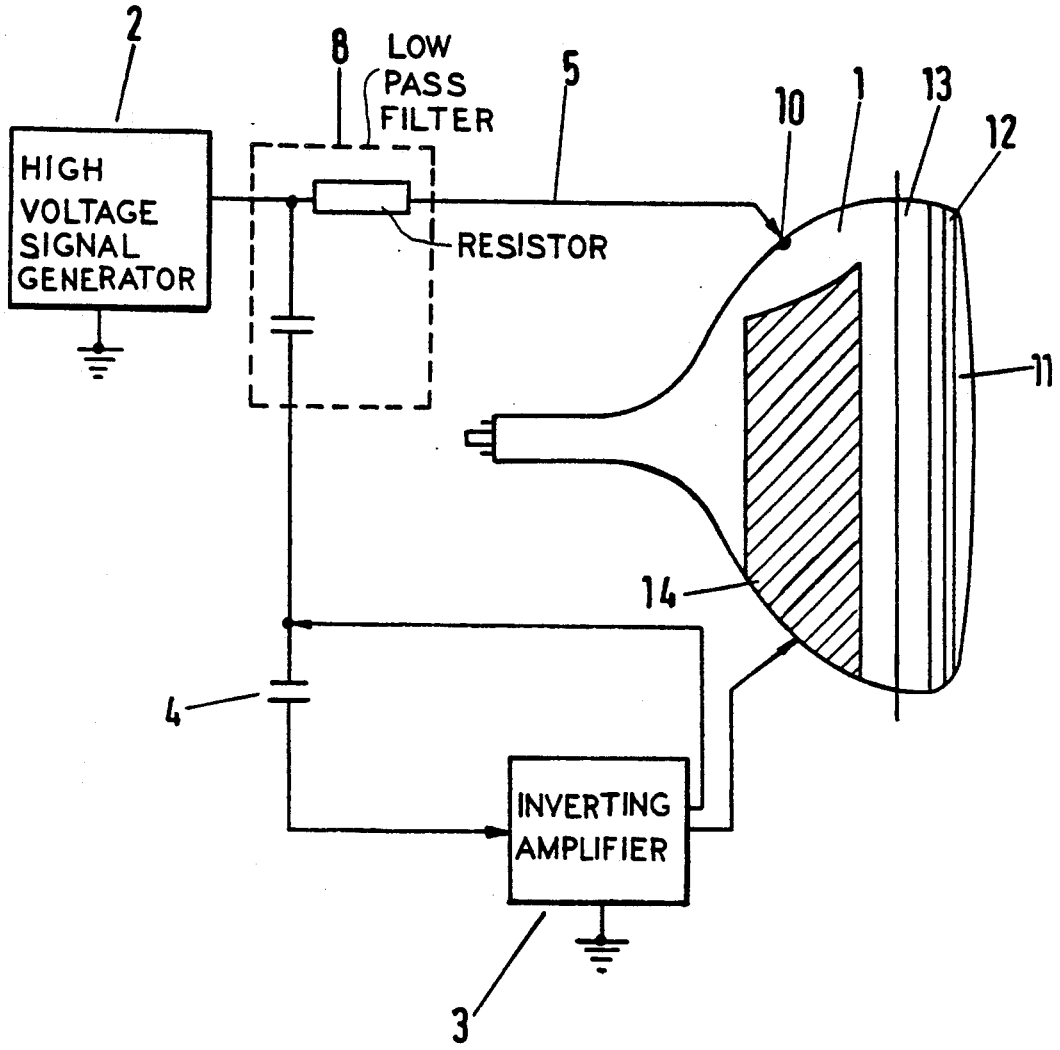
FIG. 4 is a schematic illustration of a third alternating field compensation arrangement.

As illustrated in FIG. 4, a further arrangement for compensating the undesirable AC field is comprised in coupling a low-pass filter 8, constructed of a suitably matched resistor and capacitor, into the connecting line 5 between the high-voltage generator 2 and the EHT terminal 10 of the picture tube 1. The output of the low-pass filter 8 is directed to the inverting amplifier 3 by means of a capacitor 4. An output of the inverting amplifier 3 is then fed back to the output of the low-pass filter 8. Another output of the inverting amplifier 3 is then coupled to the aquadag region 14.

It can be appreciated that the output of the inverting amplifier also can be supplied to a framing band 13 of the picture tube 1 via a line such as the line B. The framing band 13 is arranged around the front surface 11 of the picture tube 1 in a manner much like that of the outer electrode 12.

It can further be appreciated that all of these arrangements can be employed individually or in any combination. The particular arrangements selected are largely dependent on the type of picture tube involved. Different solutions can be selected dependent on whether a monochrome tube or a color picture tube is involved; the size of the front surface of the picture; and the inner design of the picture tube, among other things. Different arrangements can be provided depending on economical considerations as well.

For example, in some applications where it is needed to ground the aquadag due to EMC or flash-over requirements, it is not possible to couple a signal to the aquadag. For the 14" monochrome picture tubes it has been demonstrated that it is sufficient to employ a ring electrode that surrounds the front surface of the picture tube. In contrast, given identically dimensioned color picture tubes, good compensation has been achieved by employing a suitably dimensioned low-pass filter and by forwarding a low-frequency alternating voltage onto the aquadag region as set forth in connection with FIGS. 3 and 4.

While preferred embodiments of the invention have been described, further alterations may be envisioned by those still in the relevant art, and those alternations are intended to be encompassed within the scope of the attached claims.

I claim as my invention:

1. A method of compensating the alternating electrical field resulting at the front surface of a cathode ray picture tube having an EHT terminal to which a high-voltage signal is supplied from a high-voltage signal generator, comprising the steps of:

(a) sensing an alternating voltage signal at the EHT terminal;

(b) inverting and amplifying the sensed signal;

(c) transmitting the inverted and amplified sensed signal to at least one electrode positioned in the immediate vicinity of the picture tube to generate a compensating field; and (d) compensating the alternating electrical field at the front surface of the picture tube with the compensating field generated by said transmitted inverted and amplified sensed signal.

2. The method of claim 1 comprising the further step of controlling the gain of the amplification of the sensed signal.

3. The method of claim 1 comprising the further step of filtering the sensed signal to remove any DC voltage signals prior to inversion and amplification.

4. The method claim 1 comprising the step of transmitting the inverted and amplified sensed signal to an aquadag region of the cathode ray picture tube.

5. The method of claim 1 wherein the step of sensing comprises tapping into a connecting line coupling the high-voltage signal generator and the EHT terminal by means of a sleeve surrounding the connecting line.

6. The method of claim 1 wherein the step of transmitting the inverted and amplified sensed signal to at least one electrode comprises transmitting the inverted and amplified sensed signal to two or more electrodes positioned in the immediate vicinity of the picture tube.

7. An arrangement for compensating the alternating electrical field resulting at the front surface of a cathode ray picture tube having an EHT terminal to which a high-voltage signal is supplied by a high-voltage signal generator electrically connected thereto, comprising:

(a) at least one electrode positioned externally in the immediate proximity of the picture tube;

(b) a signal tap between the high voltage signal generator and the EHT terminal of the picture tube; and (c) an inverting amplifier having an input coupled to the signal tap and an output coupled to the electrode so that the alternating electrical field at the front surface of the cathode ray tube is compensated by the inverse of a signal present at the EHT terminal.

8. The arrangement of claim 7 wherein the gain of the inverting amplifier is controllable.

9. The arrangement of claim 7 wherein the external electrode is positioned outside the front surface of the picture tube.

10. The arrangement of claim 9 wherein the external electrode that at least partially surrounds the front surface of the picture tube.

11. The arrangement of claim 7 wherein the external electrode comprises a ring electrode arranged outside the front surface of the picture tube.

12. The arrangement of claim 7 wherein the external electrode comprises a framing band that surrounds the picture tube.

13. The arrangement of claim 7 wherein the external electrode comprises an aquadag region of the picture tube.

14. The arrangement of claim 7 wherein the signal tap comprises a metallic sleeve that at least partially surrounds a connecting line coupling the high-voltage signal generator to the EHT high-voltage terminal of the picture tube.

15. The arrangement of claim 14 wherein the metallic sleeve is made of copper.

16. The arrangement of claim 7 further comprising a low-pass filter positioned between the high-voltage signal generator and the EHT terminal, to which low pass filter the input of the inverting amplifier is connected.

17. The arrangement of claim 16 wherein the input of the inverting amplifier is coupled to the low-pass filter by means of a capacitor and an output of the inverting amplifier is coupled to the output of the low-pass filter to provide feedback to the input of the inverting amplifier.

18. The arrangement of claim 7 comprising two or more electrodes positioned externally in the immediate vicinity of the picture tube to which the output of the inverting amplifier is coupled.

19. A cathode ray picture tube construction comprising:

a cathode picture tube having an EHT high-voltage signal terminal;

a high-voltage signal generator coupled to the EHT terminal;

at least one external electrode positioned in the immediate proximity of the picture tube; and an inverting amplifier having an input coupled to an output of the high-voltage signal generator and an output coupled to the external electrode such that a signal present at the EHT terminal is inverted and used to compensate an alternating signal present at the front of the cathode ray picture tube.

20. The cathode ray picture tube construction of claim 19 further comprising a filter coupled between the input of the inverting amplifier and the output of the high-voltage signal generator.

21. The cathode ray picture tube construction of claim 19 wherein the external electrode comprises a ring electrode arranged outside the front surface of the picture tube.

22. The cathode ray picture tube of claim 19 wherein the external electrode comprises a framing band that surrounds the picture tube.

23. The cathode ray picture tube of the claim 19 wherein the external electrode comprises an aquadag region of the picture tube.

24. The cathode ray picture tube of claim 19 further comprising a metallic sleeve positioned about a connecting line that couples the output of the high-voltage signal generator to the EHT terminal, the input of the inverting amplifier being coupled to the metallic sleeve.

25. The cathode ray picture tube of claim 19 comprising two or more external electrodes positioned in the immediate vicinity of the picture tube to which the output of the inverting amplifier is coupled.

* * * * *